United States Patent [19]

Hirakawa et al.

[11] 4,368,465

[45] Jan. 11, 1983

[54] METHOD OF ACTUATING A PLASMA DISPLAY PANEL

[75] Inventors: Osamu Hirakawa; Tadatsugu Hirose, both of Suzaka, Japan

[73] Assignee: Fujitsu Limited, Kawasaki, Japan

[21] Appl. No.: 290,974

[22] Filed: Aug. 7, 1981

[30] Foreign Application Priority Data

Aug. 14, 1980 [JP] Japan ..... 55-111103

[51] Int. Cl.[3] ..... G09G 3/28

[52] U.S. Cl. ..... 340/771; 340/805; 340/811; 315/169.4

[58] Field of Search ..... 340/771, 776, 805, 811; 315/169.4

[56] References Cited

U.S. PATENT DOCUMENTS 3,906,451 9/1975 Strom ..... 315/169.4 X

*Primary Examiner*—David L. Trafton

*Attorney, Agent, or Firm*—Staas & Halsey

[57] ABSTRACT

A method of actuating a PDP device uses an actuating pulse signal which comprises an erasing mode for erasing data displayed on a display panel, a writing mode for writing new data on the panel and a sustaining mode for sustaining a state of displaying the data. The data to be displayed are input by an input signal which is not synchronized with the actuating pulse signal. At and before the time of changing the mode of the actuating pulse signal, at least one pulse is eliminated from the actuating pulse signal.

6 Claims, 10 Drawing Figures

METHOD OF ACTUATING A PLASMA DISPLAY PANEL

BACKGROUND OF THE INVENTION

The present invention relates to a method of actuating an AC memory type plasma display panel which will be identified as PDP hereafter.

An AC memory type PDP device has many advantageous points such as compactness, good displaying ability and reliability. Such a PDP device is used as an output data displaying device for a computer in a bank service system or a marketing system for articles. The PDP device is actuated by a pulse signal which comprises a sustaining mode, an erasing mode and a writing mode. The sustaining mode applies AC voltage pulses of a constant frequency so as to avoid ignition miss or wrong display and to obtain a power margin. The erasing mode comprises a pulse thinner than the pulse of the sustaining mode. The writing mode comprises a pulse of a higher voltage than the pulse of the sustaining mode or the erasing mode. Data to be displayed is input by an input signal which is not synchronized with the actuating pulse signal of the PDP. As an example of the input signal, the input signal which is used in CRT devices (Cathode-Ray Tube Device) can be used as the input signal of the PDP. Such an input signal is not synchronized with the actuating signal of PDP. Such an input signal sometimes forms an extra pulse of the same shape as the shape of the erasing pulse on the actuating pulse signal of the PDP at the time the mode of the actuating pulse signal is changed, thereby erasing all of the data displayed on the PDP.

The present invention was made with the above points in mind.

SUMMARY OF THE INVENTION

It is an object of the present invention to provide a method of actuating a PDP device, using an actuating pulse signal which comprises an erasing mode for erasing data displayed on a display panel, a writing mode for writing new data on the panel and a sustaining mode for sustaining a state of displaying the data. The data to be displayed are input by an input signal which is not synchronized with the actuating pulse signal. At and before the time of changing the mode of the actuating pulse signal, at least one pulse is eliminated from the actuating pulse signal.

DESCRIPTION OF THE PREFERRED EMBODIMENTS

Figure 1:
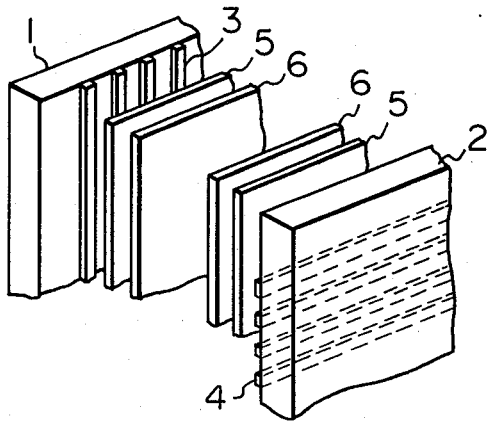
FIG. 1 is a perspective view of a disassembled PDP device.
Figure 2:
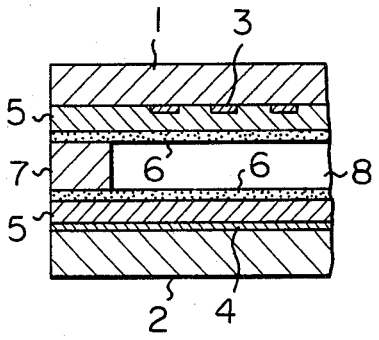
FIG. 2 is a sectional view of the PDP device.

An example of a display panel of the PDP device will be described with reference to FIGS. 1 and 2. A transparent glass plate 1 has a plurality of vertical electrodes 3. Another transparent glass plate 2 has a plurality of horizontal electrodes 4. A dielectric layer 5 and a cover layer 6 are coated on each of the glass plates 1 and 2 by the vaporization or spatter method. The glass plates 1 and 2 are arranged facing each other. A spacer 7 is disposed between the two glass plates 1 and 2. A mixture of gasses, comprising mainly neon and a small amount of argon and xenon, is introduced within the space 8 between the cover layers 6. The space 8 is sealed after introducing the mixture of the gasses. Voltage is applied to electrodes selected among the vertical and horizontal electrodes 3 and 4 so that an electric discharge occurs at the desired cross points of the electrodes 3 and 4. The mixture of gasses lights at the cross points so as to display a desired character or pattern.

Figure 3:
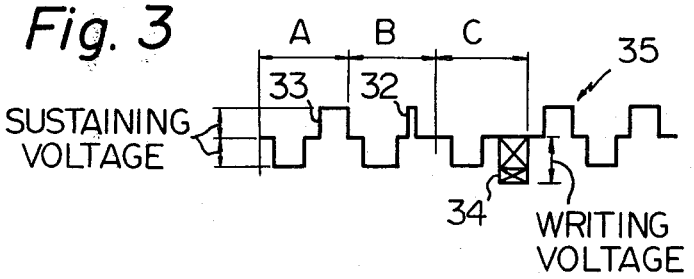
FIG. 3 is a diagram of an actuating pulse signal of the prior art.
Figure 4:
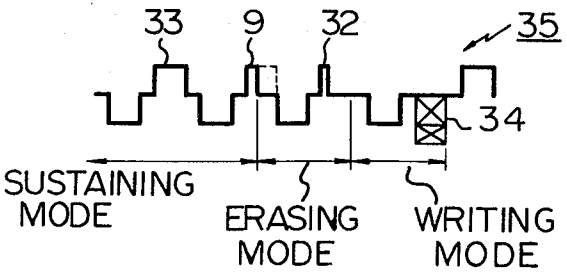
FIG. 4 is a diagram illustrating an unwanted pulse formed at the time of changing the mode according to the prior art.

The PDP device is actuated by a pulse signal 35 which comprises a sustaining mode A, an erasing mode B and a writing mode C, as illustrated in FIG. 3. In the sustaining mode A AC voltage pulses of a constant frequency are applied to the PDP device so as to sustain a state of displaying data, as well as to avoid ignition miss or an incorrect display, and to obtain a power margin. In the erasing mode B a pulse 32, which is thinner than the pulse 33 of the sustaining mode A, is generated. In the writing mode C a pulse 34, of a higher voltage than the pulse 33 of the sustaining mode A or the pulse 32 of the erasing mode B, is generated. Data to be displayed is input by an input signal which is not synchronized with the actuating pulse signal 35. Such an input signal sometimes forms an extra pulse 9 of the same shape as the shape of the erasing pulse 32 on the actuating pulse signal 35 of the PDP at the time the mode is changed, as illustrated in FIG. 4. All of the data displayed on the PDP are erased by this extra pulse 9.

Figure 5:
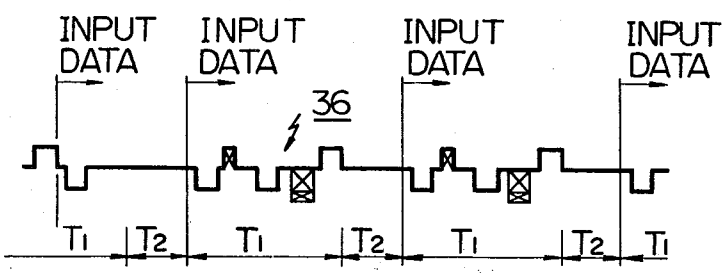
FIG. 5 is a diagram of an actuating pulse signal according to the present invention.

An actuating pulse signal 36 in accordance with the present invention is illustrated in FIG. 5. This pulse signal 36 actuates the PDP device in accordance with the input data in a period $T_1$, while AC pulses are not applied to the PDP in a successive period $T_2$. The period $T_1$ is shorter than the time for introducing one cycle of the input data. For example, if one cycle of the input data is 100 $\mu$s, the periods $T_1$ and $T_2$ may be 75 $\mu$s and 25 $\mu$s, respectively. The aforementioned extra pulse 9 cannot be formed on the actuating signal 36 at the time the input data is changed, since in the period $T_2$ there are no AC pulses which may be deformed to generate such an extra pulse 9 from the input pulse signal. Sustaining pulses are not applied to the PDP in the period $T_2$. However, the PDP maintains the state of display due to the remaining electric charge. Degradation of the luminous intensity can be minimized by shortening the time of the period $T_2$.

Figure 6:
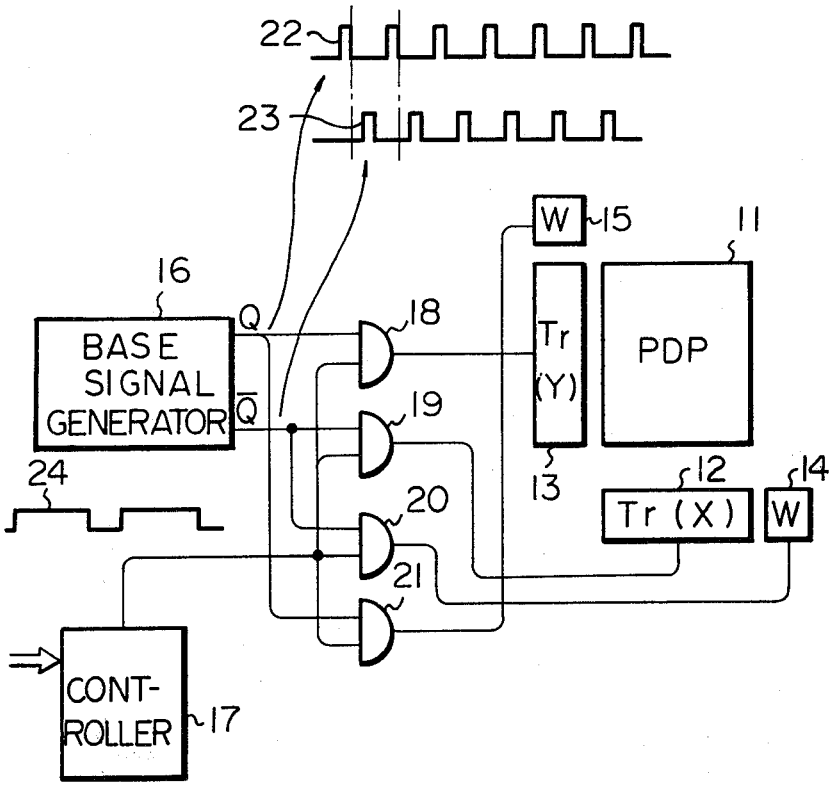
FIG. 6 is a circuit diagram of a circuit used in the method of the present invention.

An example of an actuating circuit in accordance with the present invention is illustrated in FIG. 6. This circuit comprises a PDP 11, an X direction transistor circuit 12, a Y direction transistor circuit 13, writing circuits 14 and 15, a base signal generator 16, and a controller 17. Terminals Q and $\overline{Q}$ of the base signal generator 16 and the output of the controller 17 are connected to four AND circuits 18 through 21. The outputs of the AND circuits 18 through 21 are connected to the transistor circuits 12 and 13 and to the writing circuits 14 and 15. Base signals 22 and 23 from the base signal generator 16 have different phases from each other. The base signals 22 and 23 are introduced to the AND circuits 18 through 21. The output signal 24 of the controller 17 is also introduced to the AND circuits 18 through 21. The actuating signal 36, illustrated in FIG. 5, can be obtained from the AND circuits 18 through 21.

Figure 7:
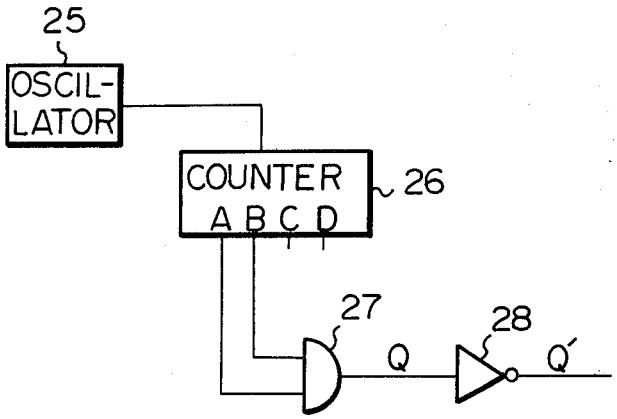
FIG. 7 is a circuit diagram of a circuit for generating pulses for input to a controller according to the present invention.
Figure 8:
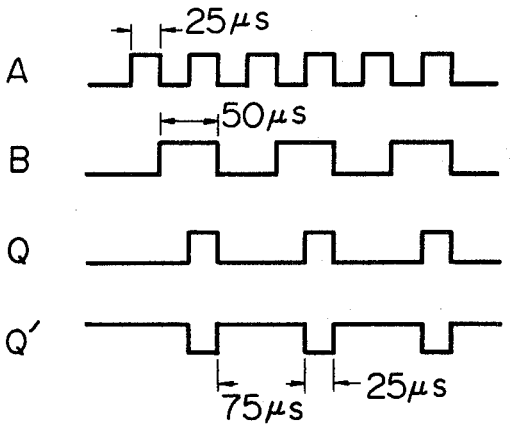
FIG. 8 is a diagram of the output signal of the controller.

The output signal 24 of the controller 17 can be generated by a circuit such as that illustrated in FIG. 7. An oscillator 25 generates a pulse signal of 40 KHz which is supplied to a counter 26. The output signal from a terminal A of the counter 26 is of 25 μs pulse width, as illustrated in FIG. 8(A). The output signal from another terminal B of the counter 26 is of 50 μs pulse width as illustrated in FIG. 8(B). These pulse signals A and B are input to an AND circuit 27. The output signal Q is illustrated in FIG. 8(Q). This signal Q is inverted by an inverter 28 so as to generate a pulse signal Q' as illustrated in FIG. 8(Q') which is the same as the signal 24 in FIG. 6.

Figure 9:
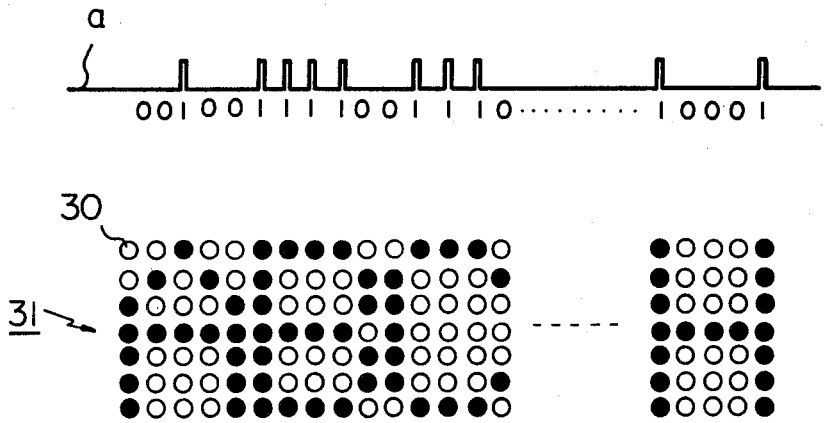
FIG. 9 is a schematic diagram illustrating an example of the display panel.
Figure 10:
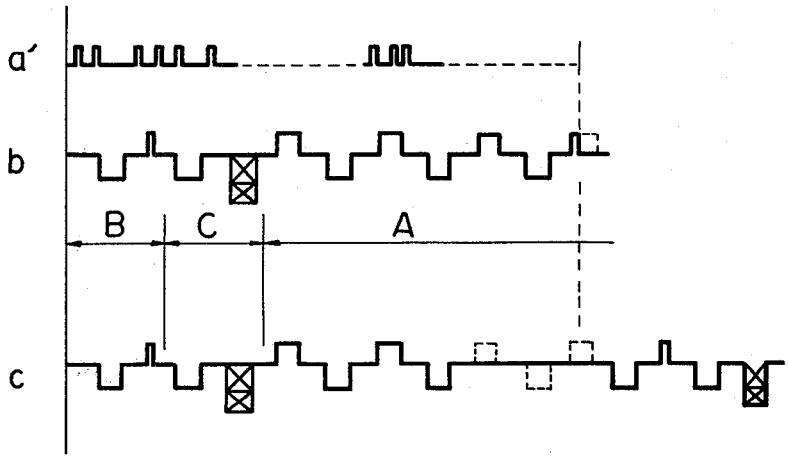
FIG. 10 is a diagram contrasting the actuating pulse signals of the prior art and the present invention.

An example of the display panel is illustrated in FIG. 9. The display panel 31 comprises a number of dots 30 which show characters A, B, C, . . . H in this example. An input signal (a) comprises signal "0" and signal "1" as illustrated in FIG. 9. This input signal (a) corresponds to the uppermost row of dots of the display panel 31. A pulse signal comprising "1" and "0" is input to each row. Signals "1" correspond to the black dots while signals "0" correspond to the white dots. Each dot in every row is actuated by the signal "1" or "0" in accordance with each input signal so that the desired character is displayed on the display panel. Actuating pulse signals (b) and (c) which actuate the display panel in accordance with the input signal are illustrated in FIG. 10. The signal (b) is that of the prior art. The signal (c) is that of the present invention. These signals actuate the PDP as follows. The erasing mode B erases the former display pattern in each row. Then, the writing mode C writes a new display pattern in the row in accordance with the input signal. This display pattern is maintained by the sustaining mode A. The erasing mode B and the writing mode C actuate only the dots in the one row corresponding to the input signal, while the sustaining mode A actuates all of the dots in the display panel. Then, a new input signal a' is introduced. When the new input signal a' is completely introduced to the actuating circuit of the PDP, the mode of the actuating signal is changed from the sustaining mode A to the erasing mode B so as to erase the displayed pattern on the one row to which the input signal is to apply. However, in the case of the actuating signal (b), the sustaining pulse may be deformed to make a shape which is the same as the shape of the erasing pulse. Such a deformed sustaining pulse erases all of the displayed pattern on the display panel since the sustaining mode is commonly applied to all of the dots on the display panel. On the other hand, in accordance with the present invention, sustaining pulses positioned at and before the time of changing the mode are eliminated as illustrated in FIG. 10(c). A timer circuit may be used for generating a signal for eliminating sustaining pulses at a predetermined time after the new input signal (a') enters. In such an actuating signal (c), an extra erasing pulse cannot be generated in the sustaining mode, since there are no sustaining pulses around the time the mode is changed. Therefore, it is possible to avoid simultaneous erasure of all of the data displayed on the display panel. After that, a normal erasing mode is applied to the selected row so that the pattern displayed only on this row is erased. Then, new data is written into this row in accordance with the input signal (a'). Such an operation is conducted in series from the uppermost row to the lowermost row, so that the desired characters are displayed on the display panel.

As mentioned above, in accordance with the present invention, a cycle of the actual actuating mode, including pulses, is shorter than a cycle of the input signal which is not synchronized with the actuating signal. Such a short actuating mode is obtained by eliminating at least one pulse from the actuating signal at about the time the mode is changed. By using the actuating signal of the present invention, it is possible to introduce an input signal of data to be displayed without occurence of unintentional erasure of the data displayed on the display panel.

We claim:

1. A method of actuating a PDP device using an actuating pulse signal having an erasing mode, a writing mode and a sustaining mode which comprises the steps of:

erasing data displayed on a display panel during the erasing mode;

writing new data on the panel during the writing mode; and sustaining the display of data during the sustaining mode, the data to be displayed being input by an input signal which is not synchronized with said actuating pulse signal, at least one pulse being eliminated from said actuating pulse signal prior to and during the time the mode of said actuating signal changes.

2. A method of actuating a PDP device according to claim 1, wherein said at least one pulse is eliminated prior to and during the time the mode is changed from the sustaining mode to the erasing mode.

3. A method of actuating a PDP device according to claim 1, wherein the display panel comprises a plurality of rows of dots, said method further comprising the steps of providing an input signal indicating data to be displayed; and actuating each row of the display panel, independently in dependence upon the input signal, wherein each input signal comprises "1" level signals and "0" level signals one of which is applied to each dot in the row.

4. A method of actuating a plasma display panel comprising the steps of:

(a) providing an input signal representing data to be displayed;

(b) generating an actuating pulse signal, having an erase mode, a write mode and a sustain mode, for actuating the plasma display panel, at least one pulse in said actuating pulse signal being eliminated from said actuating pulse signal prior to and during the time the mode of said actuating pulse signal changes, said actuating pulse signal not being synchronized with said input signal;

(c) erasing data displayed on the plasma display panel during the erase mode of said actuating pulse signal;

(d) writing new data on the plasma display panel, during the write mode of said actuating pulse signal, in dependence upon the input signal; and (e) sustaining the display of data on the plasma display panel during the sustain mode of said actuating pulse signal.

5. A method of actuating a plasma display panel device according to claim 4, wherein said step (b) comprises the substep of eliminating said at least one pulse from said actuating pulse signal prior to and during the time said actuating pulse signal changes from the sustain mode to the erase mode.

6. A method of actuating a plasms display panel device according to claim 4, wherein said plasma display panel comprises a pluality of rows and dots and wherein said step (a) comprises the substeps of:

providing a plurality of input signals representing data to be displayed on each row of the plasma display panel; and actuating each row of the plasma display panel independently in dependence upon one of the plurality of input signals, wherein each of the plurality of input signals comprises a plurality of pulses of a first or second level, one of said plurality of pulses being applied to each dot in the row.

* * * * *

UNITED STATES PATENT AND TRADEMARK OFFICE

CERTIFICATE OF CORRECTION

PATENT NO. : 4,368,465

DATED : JANUARY 11, 1983

INVENTOR(S) : OSAMU HIRAKAWA ET AL.

It is certified that error appears in the above-identified patent and that said Letters Patent is hereby corrected as shown below:

Col. 1, line 26, "Device" should be --device--.

Col. 6, line 1, "plasms" should be --plasma--.

Signed and Sealed this

First Day of November 1983

[SEAL]

*Attest:*

GERALD J. MOSSINGHOFF

*Attesting Officer*

*Commissioner of Patents and Trademarks*